United States Patent [19]

Foster

[11] Patent Number: 5,018,473

[45] Date of Patent: May 28, 1991

[54] DINGHY TOWING MECHANISM AND METHOD

[76] Inventor: Ronald Foster, 23 Red Oak Drive, Richmond Hill, Ontario, Canada, L4B 1V5

[21] Appl. No.: 426,295

[22] Filed: Oct. 24, 1989

[51] Int. Cl.[5] ..... B63B 21/58

[52] U.S. Cl. ..... 114/249; 114/373; 114/259; 414/137.9

[58] Field of Search ..... 114/343, 44, 45, 258–260, 114/365, 366, 368, 369, 373, 377, 249, 250, 242; 414/137.9, 138.5, 138.8

[56] References Cited

U.S. PATENT DOCUMENTS

| | | | |
|---|---|---|---|
| 2,530,840 | 11/1950 | Post | 114/365 |
| 3,143,991 | 8/1964 | Anderson | 114/365 |
| 3,647,089 | 3/1972 | Christensen | 114/373 |
| 4,157,596 | 6/1979 | Green | 114/365 |
| 4,850,295 | 7/1989 | Weaver | 114/259 |
| 4,864,951 | 9/1989 | Koepp, Jr. | 114/366 |
| 4,878,450 | 11/1989 | Schmidt, Jr. | 114/259 |

*Primary Examiner*—Ed Swinehart

*Attorney, Agent, or Firm*—Mirek A. Waraksa

[57] ABSTRACT

A dinghy is towed from the stern of a sailboat or power boat with the stern of the dingy and associated motor forward and raised from the water. An associated towing mechanism includes a pair of rigid tubular members which are connected between the stern of the boat and the transom of the dinghy. Pivot connections permit upward and downward pivoting of the tubular members relative to the boat and permit pivoting of the dinghy upwardly and downwardly relative to the tubular members. A pair of rope lines support the tubular members against downward pivoting. The lines are releasably retained against paying out by a pair of line retainers adapted for installation on a pre-existing rail commonly mounted at the stern of many boats. An additional line permits the bow of the dinghy to be raised from the water and pivoted upwardly against the stern of the boat thereby permitting both dinghy and motor to be stored entirely removed from the water. The mechanism incidentally permits the motor of the dinghy to be conveniently removed to the boat.

10 Claims, 5 Drawing Sheets

DINGHY TOWING MECHANISM AND METHOD

FIELD OF THE INVENTION

The invention relates to the towing of dinghys behind sailboats or power boats.

BACKGROUND OF THE INVENTION

In the operation of a sailboat, a motorized dinghy commonly serves as a lifeline between shore and boat. A sailboat is often anchored off-shore and the dinghy serves as the only means for transferring persons and supplies between shore and the boat. A dinghy may commonly be used for similar purposes in connection with the operation of a power boats.

For a long time, handling of the dinghy, particularly while the associated boat is in motion, has posed problems. The accepted practice is simply to tow the dinghy with a length of rope connecting the bow of the dinghy to the stern of the boat. The length might typically be about 40 feet or otherwise selected so that the dinghy rides in a relatively stable fashion on the stern wave of the boat.

Problems arise if the dinghy motor is not removed during such towing. One consideration is that there is considerable drag on the boat, a matter very significant to the operation of a small pleasure craft. There is also a serious risk that the motor will be flooded with water if the dinghy submerges or may flooded with wave action in rough waters. Such occurrences are relatively common.

Removal of the motor leads to other problems. In particular, the dinghy tends to drift erratically because of its relatively light-weight construction. The drifting problem becomes particularly acute in narrow waterways where there may be other vessels and permanent structures. (Considerable drifting is experienced even when the motor is attached, particularly when the towing vessel slows down.) Also, the dinghy cannot be used without first installing the motor. Such installation is difficult since most dinghies are not particularly stable craft and even minor changes in weight distribution can shift and tilt a dinghy dramatically. Installing a motor on a dinghy especially in open-waters lends itself to loss of the motor and to personal injury, quite apart from considerations of the time required. Because of the difficulties and inconvenience associated with motor removal and installation, many sailboat operators elect simply to tow both the dinghy with motor and accept the risk of water damage.

An alternative is to store the dinghy aboard the boat itself, usually on the foredeck. However, deck space is usually very limited on a boat and cannot readily be allocated to such purposes. Many dinghies are now deflatable and permit convenient storage, but deployment of the dinghy becomes even more time-consuming and troublesome.

These problems have long been recognized. To the knowledge of the inventor, no practical solution has been provided and boat owners have simply tolerated such problems. The present invention addresses such problems and offers a practical solution.

SUMMARY OF THE INVENTION

In one aspect, the invention provides a boat and dinghy in combination with a towing mechanism coupling the dinghy to the boat. The mechanism comprises a pair of elongate rigid members in horizontally-spaced apart relationship. First pivot connections couple first ends of the rigid members to the stern of the boat and permit upward and downward pivoting of the rigid members relative to the boat. Second pivot connections couple second ends of the rigid members to the stern of the dinghy and permit upward and downward pivoting of the dinghy relative to the rigid members. These are made releasable to permit the dinghy to be disengaged for use. A pair of lines support the rigid members against downward pivoting relative to the boat. Line retainers or holding means secured to the boat hold the pair of lines against paying out when supporting the rigid members, but are releasable from the lines to permit either hauling in or paying out.

In practice, the stern of the dinghy may be coupled by the rigid members and the various pivot connections to the stern of the boat. The lines supporting the two rigid members can then be hauled in to raise the stern of the dinghy and the associated motor from the water and can then be secured by the line retainers to maintain the dinghy in such an orientation. When towed in partially-raised and stern-first immediately behind the boat, contrary to conventional practices, drag is very significantly reduced. The amount of drifting which occurs is also very significantly reduced. There is less likelihood of the dinghy being submerged in such an orientation even in rough waters. Even if the dinghy were to submerge or deflate (leaks in inflatable dinghies being quite common), the motor is fully-supported above the water and unaffected. Lastly, the need to install the motor prior to deploying the dinghy and the attendant hazards are eliminated.

Various aspects of the present invention will be described in greater detail below in connection with a description of a preferred embodiment and will be more specifically defined in the appended claims.

DESCRIPTION OF THE DRAWINGS

The invention will be better understood with reference to drawings in which.

DESCRIPTION OF PREFERRED EMBODIMENT

Figure 1:
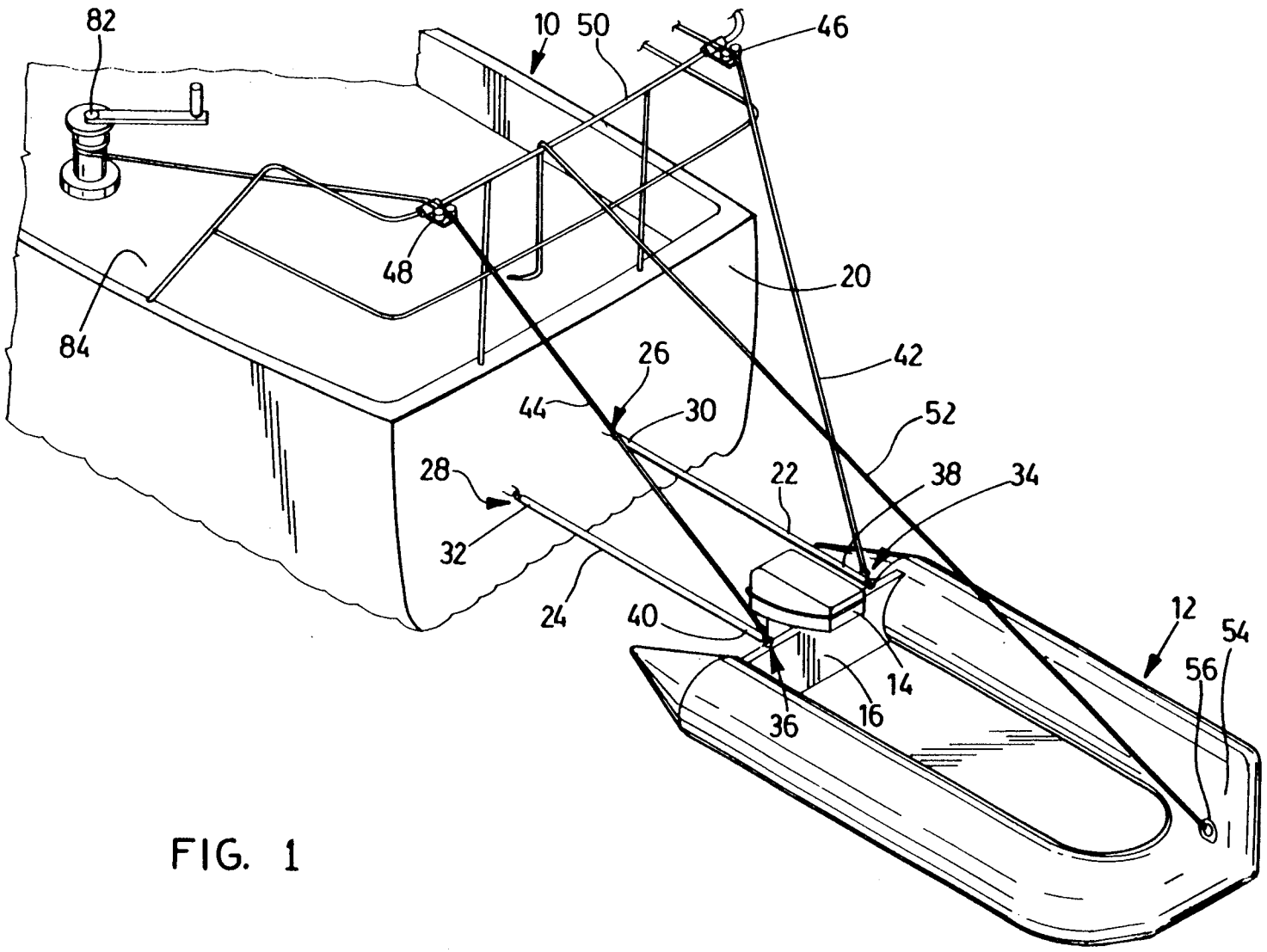
FIG. 1 is a fragmented perspective view showing a dinghy secured to a sailboat with a mechanism embodying the invention.

FIG. 1 shows a sailboat 10, a dinghy 12 with a motor 14 attached to its transom 16, and a mechanism 18 securing the dinghy 12 to the stern 20 of the boat 10.

In very general terms, the mechanism 18 comprises a pair of elongate, rigid members 22, 24, each of tubular stainless steel and each approximately 48 inches in length. A first pair of pivot connections 26, 28 couple ends 30, 32 of the tubular members 22, 24 to the stern 20 of the boat 10 in horizontally spaced-apart relationship, the spacing being about 18 inches. These pivot connections 26, 28 permit each of the tubular members 22, 24 to be pivoted upwardly and downwardly relative to the stern 20 of the boat 10. A second pair of pivot connections 34, 36 releasably join opposite ends 38, 40 of the rigid members 22, 24 to the transom 16 of the dinghy 12 in horizontally spaced-apart relationship, the spacing once again being about 18 inches. These pivot connections 34, 36 permit the dinghy 12 to pivot upwardly and downwardly relative to the distal ends 38, 40 of the two rigid members 22, 24, and are releasable to permit quick deployment of the dinghy 12.

A pair of rope lines 42, 44 support the distal ends 38, 40 of the rigid members 22, 24 against downward pivoting relative to the boat 10. These lines 42, 44 are releasably held against paying out by a pair of line retainers 46, 48 conveniently fastened to a rear tubular railing associated with the boat 10. An additional line 52 is secured to the bow 54 of the dinghy 12 by fastening to a pre-existing ring 56. The purpose of the additional line 52 is to permit the forward end of the dinghy 12 to be pivoted upwardly relative to the distal ends 38, 40 of the rigid tubular members 22, 24 for purposes described more fully below.

Figure 4:
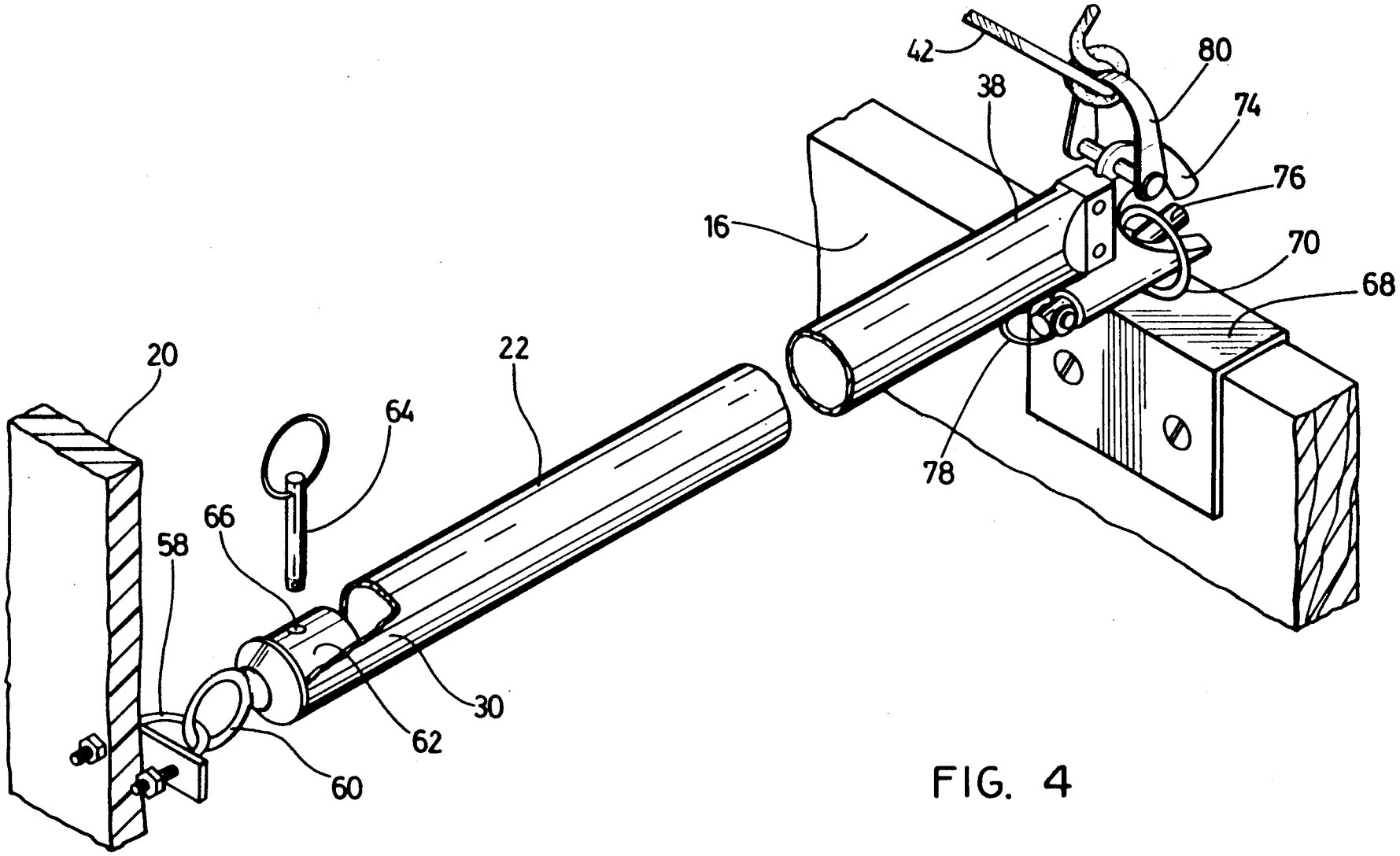
FIG. 4 is an extensively fragmented perspective view illustrating a rigid tubular member and the manner in which the member is secured both to the stern of the boat and the transom of the dinghy.

FIG. 4 provides greater detail regarding the construction and connection of the tubular member 22 between the boat 10 and dinghy 12, such description being equally applicable to the other tubular member 24. The pivot connection 26 includes a pad eye 58 bolted to the stern 20 of the boat 10 on a relatively permanent basis. It also includes a ring 60 with a rod-like shank 62 dimensioned to slide into the open end 30 of the tubular member 22 proximate to the boat 10. The ring 60 and shank 62 are releasably retained by a conventional pin 64 which extends through aligned openings (not shown) formed in the tubular member 22 and through a passage 66 formed in the shank 62.

The pivot connection 34 joining the tubular member 22 to the transom 16 includes a U-shaped bracket 68 rigidly supporting a ring 70. The bracket 68 is simply fitted about the top of the transom 16 and bolted or screwed in place. The distal end 38 of the tubular member 22 carries a connector 72 comprising an arcuate hook 74 and a spring-biased pin 76 which closes the mouth of the hook 74. The pin 76 can be retracted by drawing on a ring 78 attached to one end of the pin 76 and a string may be fastened to the ring 78 for such purposes. This arrangement permits the dinghy 12 to be very quickly disengaged from the mechanism 18 for use. Although a ring and a particular complementary releasable connector have been illustrated, a variety of complementary connectors permitting the required vertical pivoting action can be substituted for purposes of the invention.

A harness 80 is attached to the connector 72 terminating the distal end 38 of the tubular member 22 for purposes of securing the associated rope line 42. The rope line 42 can simply be knotted about the harness 80. Any structure appropriate for securing a line to the distal end 38 of the tubular member 22 to apply an upward force can be used for purposes of the invention. In a modification of the basic system described more fully below, the rope line 42 is secured to the tubular member 22 for purposes of the invention by a pulley assembly. The position at which the rope engages the tubular member 22 to apply a lifting force is not particularly critical. However, it is preferable that the point of attachment be fairly close to the distal end 38 of the tubular member 22 to facilitate pivoting about the pivot connection 26 formed at the stern 20 of the boat 10.

Figure 2:
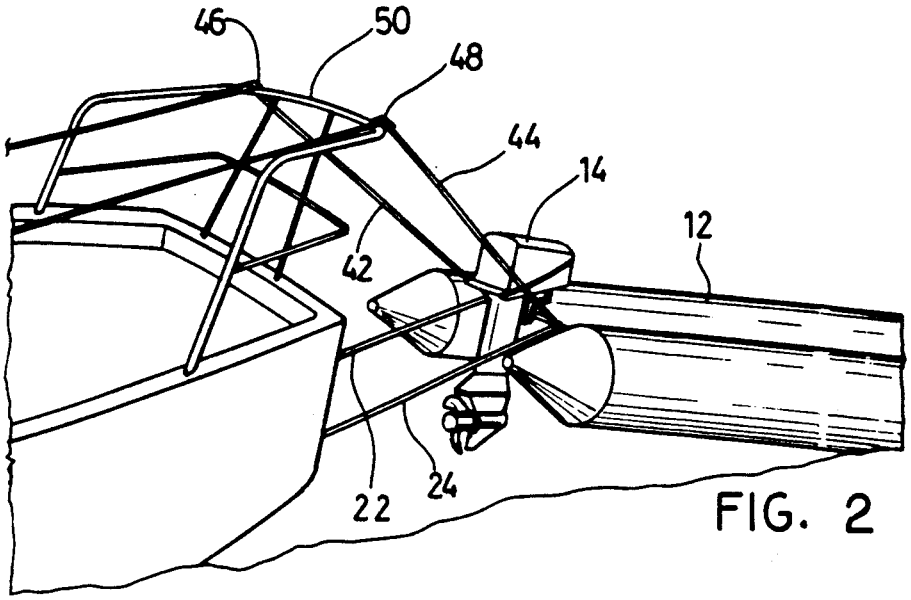
FIG. 2 is a fragmented perspective view showing the dinghy and associated motor partially-raised form the water in a towing orientation.

FIGS. 1–2 indicate how the dinghy 12 can be secured to the stern 20 of the boat 10 for towing. The tubular members 22, 24 may initially be extended substantially parallel to the water at a height commensurate with the height of the transom 16. This permits the connectors at the distal ends 38, 40 of the tubular members 22, 24 to be engaged with the eyes fixed to the transom 16. This results in the orientation apparent in FIG. 1. The rope lines 42, 44 may then be hauled in to raise the stern of the dinghy 12 and the associated motor 14 from the water. The hauling in may be done by hand or by means of winches operably coupled to the lines 42, 44, only one such winch 82 being apparent in FIG. 1. The lines 42, 44 can then be fastened to the line retainers 46, 48 to support and maintain the stern of the dinghy 12 in its raised orientation, substantially as illustrated in FIG. 2. It should be noted that winches can serve as line holding means for purposes of the invention; however, line retainers 46, 48 with conventional cleat assemblies are preferred for speed of hauling in and paying out.

As discussed above, this towing arrangement solves the problems associated with prior practices. The motor 14 and stern of the dinghy 12 are raised with only the comparatively light forward end of the dinghy 12 floating in the water. This orientation results in less drag being applied to the boat 10 when in motion. The raised-orientation and the support provided by the lines 42, 44 ensure that the motor will not be immersed in water even if the dinghy deflates or fills with water. There is consequently no need to remove the motor prior to towing, and no need to reinstall the motor prior to deployment with the attendant risk of motor loss. During towing, there is less likelihood of drifting, particularly in response to slowing of the boat 10. The relatively wide spacing of the lines 22, 24 at the railing 50 as compared to the spacing at the transom 16 allows the lines to react lateral forces applied to the dinghy 12 that tend to cause lateral drifting. Once the dinghy 12 has been deployed or removed, the tubular members 22, 24 may, if desired, be retracted to a near vertical position against the stern 20 of the boat 10. Towing mechanisms embodying the basic features of operation of the mechanism 18 are clearly practical and their construction is relatively inexpensive.

The use of a pair of horizontally spaced-apart tubular members 22, 24 is significant. These provide stability in supporting the dinghy 12 and motor 14, but also accommodate the central position of the motor 14 which might otherwise obstruct the raising function. They also result in ease of installation and proper operation even when installed by an individual who might have no experience with the towing mechanism. In particular, the relative vertical orientation of the pivot connections at the stern of the boat are not unduly critical to satisfactory operation, nor is relative horizontal spacing.

To appreciate the significance of such matters, one might consider the alternative of providing a single central support structure forked at either end to be joined by pairs of pivot connections to both the stern of a boat and the stern of dingy on either side of the associated motor. If the pivot connections at the stern are not of equal height, the central support will be inclined at an awkward angle with no guarantee that the connectors at the distal end can be secured simultaneously to the dinghy. The horizontal spacing of the pivot connections would also become a more critical factor. If the pivot connections are not precisely spaced at the rear of the dinghy, for example, it might not be possible to secure the structure to the dinghy. Another problem solved through use of two independent rigid support members is that the stern of a boat may not present surfaces appropriate for mounting of a single central structure with any measure of guaranteed horizontal alignment and predetermined horizontal spacing. In particular, in many boats, a central ladder, either fixed or removable, must be accommodated. There may also be other features and matters of shape peculiar to a particular boat which can be readily accommodated using two support members. Moreover, since the tubular members 22, 24 can be independently manipulated to complete the pivot connections at the stern of the dinghy 12, it is possible to complete such connections despite rocking and shifting of the dinghy 12, particularly in rough waters.

Figure 3:
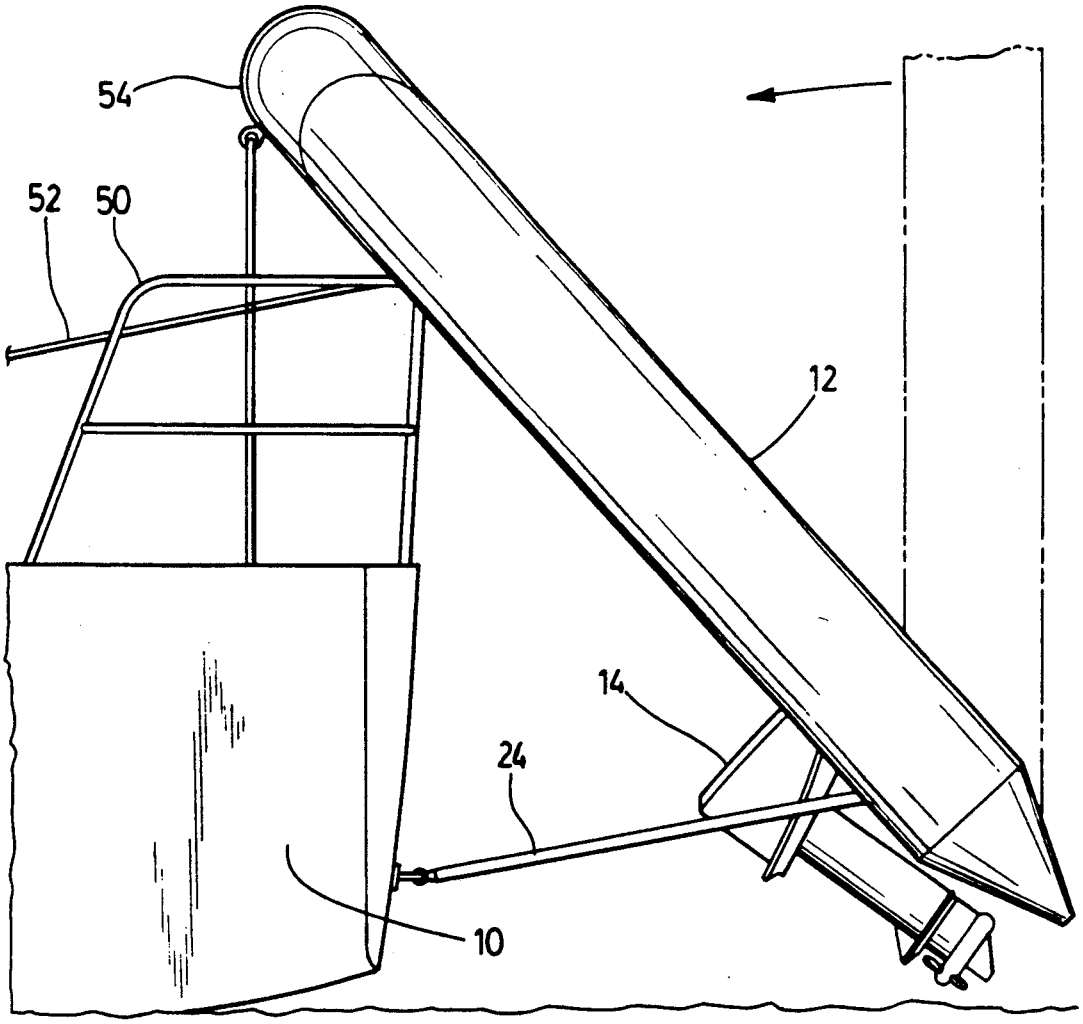
FIG. 3 is a side elevational view illustrating how the dinghy can be raised from the orientation in FIG. 2 for storage against the stern of the boat completely removed from the water.

FIG. 3 illustrates a method of storing the dinghy 12 which is particularly appropriate when the boat 10 has been moored at a dock. Prior practices in that regard have been quite cumbersome. To avoid obstructing other vessels, the dinghy motor would typically be removed and the dinghy might be hauled up by its bow and lashed against the stern of the associated boat. An alternative where deck space permits is to haul the dinghy onto the foredeck. Once travel is to be resumed, the dinghy would again be lowered into the water and the motor affixed.

The dinghy towing mechanism 18 permits the dinghy to be temporarily stored against the stern 20 of the boat 10, without motor removal, and permits quick deployment. In describing the associated storing method, it is assumed that the dinghy 12 has been towed towards a dock or like in the towing orientation of FIG. 2; that is, the steps of coupling the dinghy 12 to the stern 20 of the boat 10 and raising the motor 14 and stern of the dinghy 12 are complete. The forward end of the dinghy 12 can then be pivoted upwardly (as illustrated in FIG. 3) about the distal ends 38, 40 of the tubular members 22, 24 by hauling in the additional line 52 fastened to the bow 54 of the dinghy 12. The dinghy 12 passes through an intermediate position shown in phantom outline and is ultimately drawn to a final position shown in solid outline with the forward end of the dinghy 12 resting against the stern 20 of the boat 10. The additional line 52 can then be fastened to the deck 84 or any appropriate structure to secure the dinghy 12 in such an orientation. Other ropes of the like can alternatively be used to secure the bow of the dinghy 14 to the boat 10.

As a result of this procedure, the dinghy 12 is completely raised from the water and does not extend in a particularly obtrusive manner from the boat 10. The nuisance of motor removal and re-installation is avoided. Since the motor 14 can be raised completely from the water, if deemed necessary, and is supported in a very stable fashion, there is little concern that the motor 14 may become immersed in water. The storage process does not require considerable strength. The motor 14, which is generally the heaviest part of the dinghy 12, is positioned proximate to the pivot connections 34, 36 at the distal ends 38, 40 of the tubular members 22, 24. Accordingly, only a comparatively small force must be applied to the additional line 52 to accommodate the presence of the motor. It should be noted that, although the storage method illustrated in FIG. 3 could be used to transport the dinghy 12 during actual travel aboard the boat 10, this is not a desirable practice as the dinghy 12 would obstruct vision and would create unnecessary windage or drag.

Figure 5:
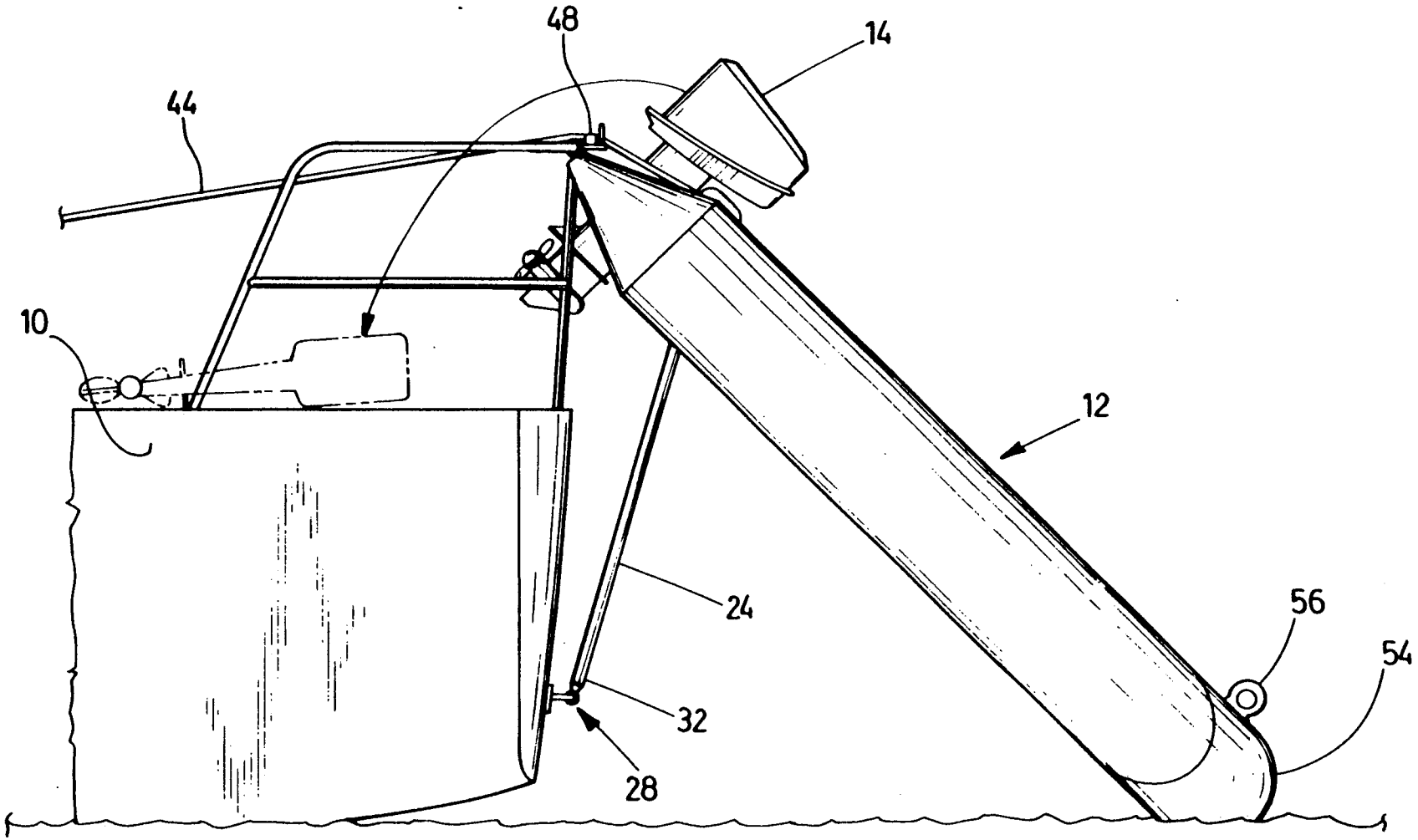
FIG. 5 is a side elevational view showing how the stern of the dinghy can be raised for purposes of motor removal into the interior of the boat.

The mechanism 18 can also used to transfer the dinghy motor 14 to the boat 10 as illustrated in FIG. 5. In such a procedure, the dinghy 12 might initially be placed in the orientation of FIG. 1, following the securement steps described above. The tubular members 22, 24 are then raised by hauling in the rope lines 42, 44. Rather than stopping at the orientation of FIG. 2, the hauling-in process is continued until the motor 14 approaches the stern 20 of the boat 10 adjacent the railing 50 at deck level. The lines 42, 44 can then be fastened against paying out with the line retainers 46, 48 or alternatively with the winches if the latter have been used to haul in the lines 42, 44. With the stern of the dinghy 12 and the motor 14 secured in the raised orientation of FIG. 5, the motor 14 can then be conveniently loosened from the transom 16 of the dinghy 12 transferred to the deck surface of the boat 10, as indicated in phantom outline FIG. 5. The motor may be and fixed to railing 50 or removed to the interior of the boat 10. It will be appreciated that this method avoids the hazards of prior practices requiring the need to stand in a craft as relatively unstable as a floating dinghy while attempting to raise a motor either to the boat or a pier.

The towing mechanism 18 as described above will be suitable for raising the motor and stern of many dinghies by hand. Hauling in the lines 42, 44 by hand is preferred to use of winches because faster operation is normally possible. Since the lines 42, 44 cannot be hauled vertically relative to the tubular members 22, 24, but at acute angle, the amount of force required at least initially to raise the motor 14 is significantly increased. If the motor 14 is particularly heavy or the individual raising the dinghy 12 is relatively weak, difficulty may be experienced. A modification to the basic mechanism 18, illustrated in FIG. 6, addresses this problem.

Figure 6:
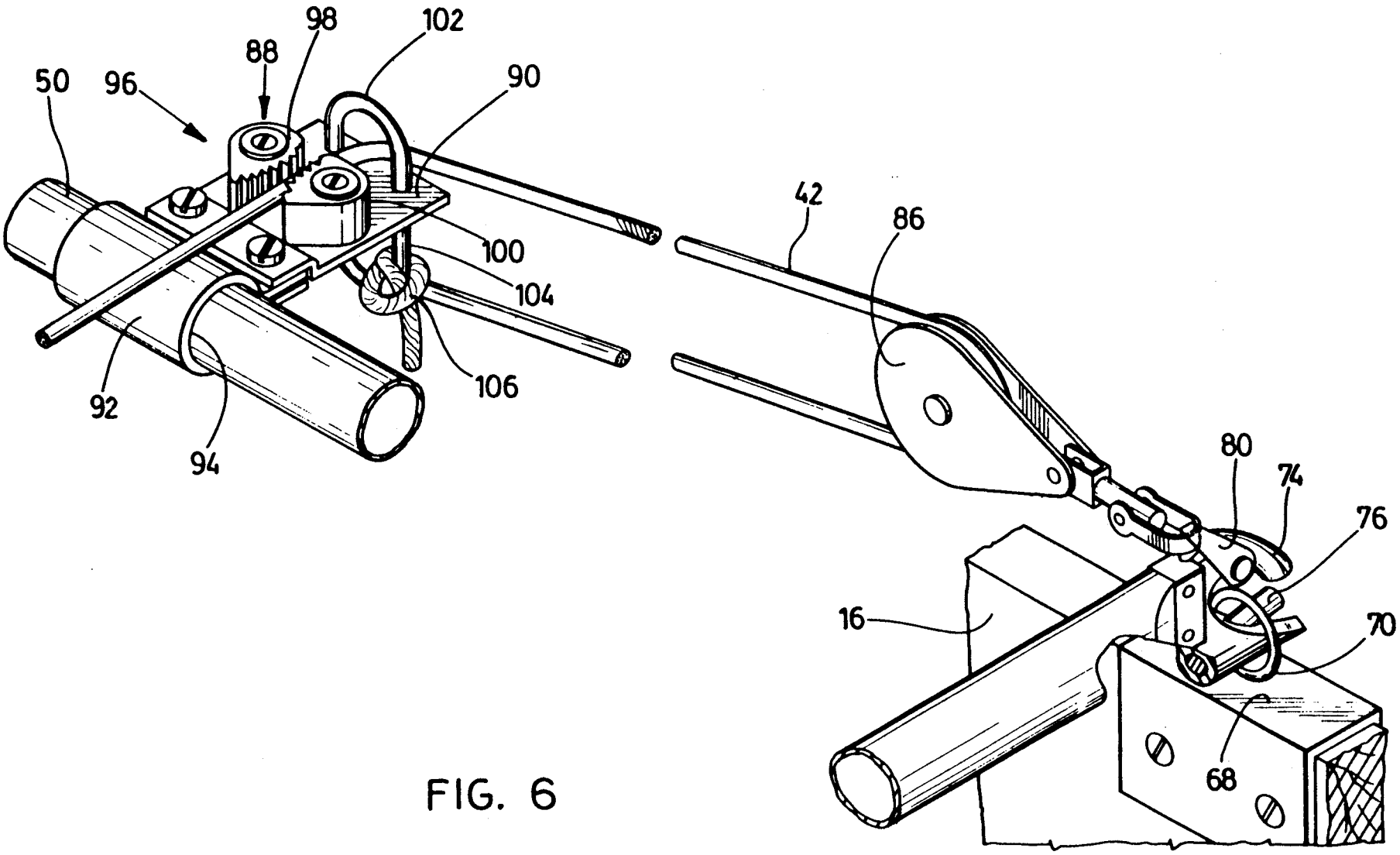
FIG. 6 shows modifications to the system of FIGS. 1–5 which facilitate raising of the dinghy.

In FIG. 6, a pulley assembly 86 has been fastened to the distal end 38 of the tubular member 22 by securing to the associated harness 80. The associated rope line 42 is operatively coupled to the pulley assembly 86 thereby supporting the distal end 38. One end of the rope line 42 must now be fixed relative to the boat 10 to obtain a mechanical advantage. Fastening the end of the rope line 42 to the tubular member 22 itself is one very convenient possibility. However, the potential mechanical advantage is significantly reduced by the angle formed between the two runs of the line 42. Securing the rope with an appropriate fastener to the stern 20 of the boat 10 would result in additional modification of the boat 10 and additional hardware. This problem is conveniently solved by adapting an associated line retainer 88 to retain the rope end.

The line retainer 88 illustrated in FIG. 6 may be seen to comprise a plate-shaped metal support structure 90. A split tubular bracket 92 with an inner cylindrical surface 94 fits conveniently about the railing 50. The bracket 92 is both held to the support structure 90 and tightened about the railing 50 by a pair of bolts. A conventional cleat assembly 96 comprising two springbiased, toothed gripping members 98, 100 normally engage the line 42 to prevent paying out in a first direction along an axis between the gripping members 98, 100. They release from the associated line 42 to permit hauling in when the line 42 is tugged in an opposite direction. A conventional fairlead or guide structure 102 consisting of a loop directs the associated line 42 to the cleat assembly 96. A rope fastener 104 in the form of another loop is attached to the support structure 90 on a side thereof opposite to the fairlead. The end 106 of the rope line 42 is simply tied about the loop.

Since many sailboats have a rear railing, the line retainer 88 can be very conveniently mounted to such a boat without requiring modification of the boat and also serves to tie off the end 106 of the rope line 42 without additional hardware and still further modification of the boat. Since the two runs of the rope line 42 are essentially parallel, the maximum mechanical advantage (a reduction by about one-half of the required lifting force) is also obtained. The other tubular member 24 will, of course, be modified in a similar manner to receive a pulley assembly and a similar line retainer would be associated with the other tubular member 24. The same basic line retainer construction, except for the rope fasteners, might be used in the line retainers 46, 48 of the more basic mechanism described above.

A variety of matters should be noted. The tubular construction of the rigid support members is not a significant aspect of the present invention. The rigid members may be made telescopic, as rigidity for purposes of the invention is required only in actual operation. This can be done in a conventional manner by installing one tube in the interior of an outer tube, forming a series of alignable holes at intervals along the lengths of the tubes, and providing a pin to fix the overall length of the resulting member. Since the materials used to construct components of the securing mechanism are preferably stainless steel, a telescopic construction can contribute significantly to cost and for that reason is not preferred. Also, the connectors used to join the proximate ends of the tubular members to the boat might be quick-release connectors similar to those used at the distal ends in the preferred embodiment. Once again, cost is the overriding consideration.

The length of the rigid members is not unduly critical, but should be selected such that a motor is appropriately positioned at deck level when raised for removal. A parallel relationship between the two members need not be maintained, as relative horizontal and vertical spacing are not critical factors. The pivot connections at the stern of the boat might, for example, be arranged to be further apart than the pivot connections at the dinghy. This would further reduce drifting.

A pair of rigid supporting members is required to provide stability. This is particularly true for purposes of motor removal where the fastening of the rigid members to either side of the motor provides reliable support. Additional rigid members similarly fastened between boat and dinghy might be used, but no significant advantage is obtained that would justify the additional costs and complexity of operation.

It will be appreciated that a particular embodiment of the invention has been described for purposes of illustrating the principles and general features of the invention, and that modifications may be made therein without departing from the spirit of the invention or necessarily departing from the scope of the appended claims.

I claim:

1. A dinghy towing mechanism in combination with a boat and a dinghy having a motor attached to its stern, the towing mechanism comprising:

a pair of elongate rigid members in horizontally spaced-apart relationship, each of the pair of rigid members having first and second ends;

a first pair of pivot connections coupling the first ends of the pair of rigid members to the stern of the boat;

a second pair of pivot connections coupling the second ends of the rigid members to the stern of the dinghy, the second pair of pivot connections being located one to either side of the dinghy motor, the second pair of pivot connections being releasable to permit disengagement of the dinghy from the rigid members;

the first and second pairs of pivot connections and the pair of rigid members being oriented to permit displacement of the dinghy between a fully-floating orientation in which both the stern and bow of the dinghy float in water behind the boat with the bow of the dinghy facing rearwardly away from the stern of the boat and a towing orientation in which the stern of the dingy and the motor are clear of the water and the bow of the dinghy floats in the water facing rearwardly away from the stern of the boat;

the elongate rigid members being moveable independently of one another and the towing mechanism defining a clearance space between the rigid members which receives the motor of the dinghy;

a pair of lines connected to the second ends of the rigid members and causing the dinghy to displace between at least the fully-floating and towing orientations in response to hauling in and paying out the pair of lines; and, line holding means secured to the boat for releasably holding the pair of lines against paying out.

2. The combination of claim 1 in which:

the first and second pairs of pivot connections and the rigid members are adapted to permit displacement of the dinghy between the fully-floating orientation and a clearance orientation in which the dinghy and motor are entirely clear of the water with the bow of the dinghy proximate to the stern of the boat and the rear of the dinghy below the bow of the dinghy;

the towing mechanism comprises a third line fastened to the bow of the dinghy and causing pivoting of the dinghy about the second pair of pivot connections in response to hauling in and paying out the third line; and, means secured to the boat for releasably holding the third line against paying out.

3. The combination of claim 1 in which the first and second pairs of pivot connections and the rigid members are adapted to permit displacement of the dinghy between the fully-floating orientation and an orientation in which the stern of the dinghy and the motor are proximate to a deck surface at the stern of the boat and the bow of the dinghy is positioned below the stern of the dinghy in response to hauling in the pair of lines.

4. The combination of claim 1 in which the line holding means comprise a cleat assembly.

5. The combination of claim 1 in which the line holding means comprise a pair of winches each coupled to a different one of the pair of lines.

6. The combination of claim 1 in which the line holding means comprise a pair of line retainers each associated with a different one of the pair of lines, each line retainer comprising:

a support structure;

a cleat assembly adapted to engage the associated line to prevent paying out and releasable from the associated line to permit hauling in;

means attached to the support structure for releasably securing the support structure to a tubular portion of a railing fixed to the boat.

7. The combination of claim 1 in which:

the line holding means comprise a pair of line retainers each associated with a different one of the pair of lines, each line retainer comprising a support structure, means attached to the support structure for releasably retaining the associated line, and means for releasably securing the support structure to a tubular portion of a railing mounted on the boat;

the towing mechanism comprises a pair of pulley assemblies each associated with a different one of the rigid members and means connecting each of the pulley asseblies to the associated rigid member adjacent the second end of the associated rigid member;

each of the pair of lines has one stationery end portion secured to the support structure of the associated line retainer and is operatively engaged with a different one of the pulley assemblies thereby permitting the dinghy to be raised from the water with a predetermined mechanical advantage.

8. A method of towing a dinghy from a boat, the dinghy having a motor attached to its stern, comprising:

connecting the stern of the dinghy to the boat with the dinghy in a fully-floating orientation in which both the stern and bow of the dinghy float in water behind the boat and the bow of the dinghy faces rearwardly away from the stern of the boat, the connecting comprising securing a pair of rigid elongate members in horizontally spaced-apart relationship between the stern of the boat and the stern of the dinghy with a first pair of pivot connections coupling first ends of the pair of rigid members to the stern of the boat and with a second pair of pivot connections releasably coupling the second ends of the rigid members to the stern of the dinghy, the second pair of pivot connections being located one to either side of the dinghy motor;

displacing the dinghy from the fully-floating orientation to a towing orientation in which the stern of the dinghy and the motor are clear of the water and the bow of the dinghy floats in the water facing rearwardly away from the stern of the boat by hauling in a pair of lines connected to the second ends of the rigid members; and, securing the pair of lines to the boat against paying out when the dinghy is in the towing orientation.

9. A method of transferring a motor attached to the stern of a dinghy to a boat, comprising:

connecting the stern of the dinghy to the boat with the dinghy in a fully-floating orientation in which both the stern and bow of the dinghy float in water behind the boat and the bow of the dinghy faces rearwardly away from the stern of the boat, the connecting comprising securing a pair of rigid elongate members in horizontally spaced-apart relationship between the stern of the boat and the stern of the dinghy with a first pair of pivot connections coupling first ends of the pair of rigid members to the stern of the boat and with a second pair of pivot connections releasably coupling the second ends of the rigid members to the stern of the dinghy, the second pair of pivot connections being located one to either side of the dinghy motor;

displacing the dinghy from the fully-floating orientation to a motor-removal orientation in which the stern of the dinghy is proximate to a deck surface at the stern of the boat by hauling in a pair of lines connected to the seconds ends of the rigid members and then securing the pair of lines to the boat against paying out; and, removing the motor to the deck surface while the dinghy is in the motor-removal orientation and the pair of lines are secured against paying out.

10. A method of storing a dinghy on a boat with a motor attached to the stern of the dinghy, comprising:

connecting the stern of the dinghy to the boat with the dinghy in a fully-floating orientation in which both the stern and bow of the dinghy float in water behind the boat and the bow of the dinghy faces rearwardly away from the stern of the boat, the connecting comprising securing a pair of rigid elongate members in horizontally spaced-apart relationship between the stern of the boat and the stern of the dinghy with a first pair of pivot connections coupling first ends of the pair of rigid members to the stern of the boat and with a second pair of pivot connections releasably coupling the second ends of the rigid members to the stern of the dinghy, the second pair of pivot connections being located one to either side of the dinghy motor;

displacing the dinghy from the fully-floating orientation to an intermediate orientation in which the stern of the dinghy is clear of the water and the bow of the dinghy is floating in the water by hauling in a pair of lines connected to the second ends of the rigid members and then securing the pair of lines against paying out;

pivoting the bow of the dinghy upwardly about the second pivot connections, after the pair of lines have been secured against paying out, by hauling in a third line attached to the bow of the dinghy until the bow of the dinghy is over the stern of the dinghy and proximate to the stern of the boat; and, securing the third line to the boat against paying out after the upward pivoting of the bow of the dinghy.

* * * * *